US011430307B2

(12) United States Patent
Li et al.

(10) Patent No.: US 11,430,307 B2
(45) Date of Patent: Aug. 30, 2022

(54) HAPTIC FEEDBACK METHOD

(71) Applicant: AAC Technologies Pte. Ltd., Singapore (SG)

(72) Inventors: Tao Li, Shenzhen (CN); Zheng Xiang, Shenzhen (CN); Xuan Guo, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 377 days.

(21) Appl. No.: 16/703,898

(22) Filed: Dec. 5, 2019

(65) Prior Publication Data

US 2020/0211338 A1 Jul. 2, 2020

(30) Foreign Application Priority Data

Dec. 31, 2018 (CN) ..... 201811651545.3

(51) Int. Cl.
*G08B 6/00* (2006.01)
*G10L 25/51* (2013.01)

(52) U.S. Cl.
CPC ..... *G08B 6/00* (2013.01); *G10L 25/51* (2013.01); *G10H 2210/031* (2013.01); *G10H 2210/041* (2013.01); *G10H 2250/235* (2013.01)

(58) Field of Classification Search
CPC .... G08B 6/00; G10L 25/51; G10H 2210/031; G10H 2250/235; G10H 2210/041
USPC ..... 700/94
See application file for complete search history.

(56) References Cited

U.S. PATENT DOCUMENTS

2011/0190008 A1* 8/2011 Eronen ..... G01C 21/20 455/456.3
2014/0161270 A1* 6/2014 Peters ..... G10L 25/24 381/63

FOREIGN PATENT DOCUMENTS

CN 102509545 A * 6/2012
CN 104707331 A * 6/2015
EP 3125076 A1 * 2/2017 ..... G06F 3/016

* cited by examiner

*Primary Examiner* — Melur Ramakrishnaiah
(74) *Attorney, Agent, or Firm* — W&G Law Group

(57) ABSTRACT

Provided a haptic feedback method, including: step S1 of algorithmically training an audio clip containing a known audio event type to obtain an algorithm model; and step S2 of obtaining an audio, identifying the audio by the algorithm model to obtain different audio event types in this audio, matching, according to a preset rule, the audio event types with different vibration effects as a haptic feedback and outputting the haptic feedback. Compared with the related art, the present haptic feedback method provides users with real-time haptic feedback when applied to a mobile electronic product, thereby achieving excellent use experience of the mobile electronic product.

2 Claims, 3 Drawing Sheets

HAPTIC FEEDBACK METHOD

TECHNICAL FIELD

The present disclosure relates to the technical field of electroacoustics, and in particular, to a haptic feedback method applied to mobile electronic products.

BACKGROUND

Haptic feedback technology is a haptic feedback mechanism that combines hardware and software with action such as acting force or vibration. The haptic feedback technology has been adopted by a large number of digital devices to provide excellent haptic feedback functions for products such as cellphones, automobiles, wearable devices, games, medical treatment and consumer electronics.

The haptic feedback technology in the related art can simulate real haptic experience of a person, and then by customizing particular haptic feedback effects, user experience and effects of games, music and videos can be improved.

However, in the related art, there is a lack of mature applications of haptic feedback schemes based on event detection. First, most existing applications based on event detection are not provided with haptic feedback functions and experiences; and second, some haptic feedback schemes of matching vibrations for audio have problems such as high requirements on audio quality, single use scenarios, and poor user experience.

Therefore, it is necessary to provide a new haptic feedback method to solve the above technical problems.

BRIEF DESCRIPTION OF DRAWINGS

Many aspects of exemplary embodiments can be better understood with reference to following drawings. Components in the drawings are not necessarily drawn to scale, the emphasis instead being placed upon clearly illustrating principles of the present disclosure. Moreover, in the drawings, like reference numerals designate corresponding parts throughout the several views.

DESCRIPTION OF EMBODIMENTS

In order to make the purpose, technical solutions, and advantages of the embodiments of the present disclosure be understandable, technical solutions in embodiments of the present disclosure are described in the following with reference to the accompanying drawings. It should be understood that the described embodiments are merely exemplary embodiments of the present disclosure, which shall not be interpreted as providing limitations to the present disclosure. All other embodiments obtained by those skilled in the art without creative efforts according to the embodiments of the present disclosure are within the scope of the present disclosure.

Figure 1:
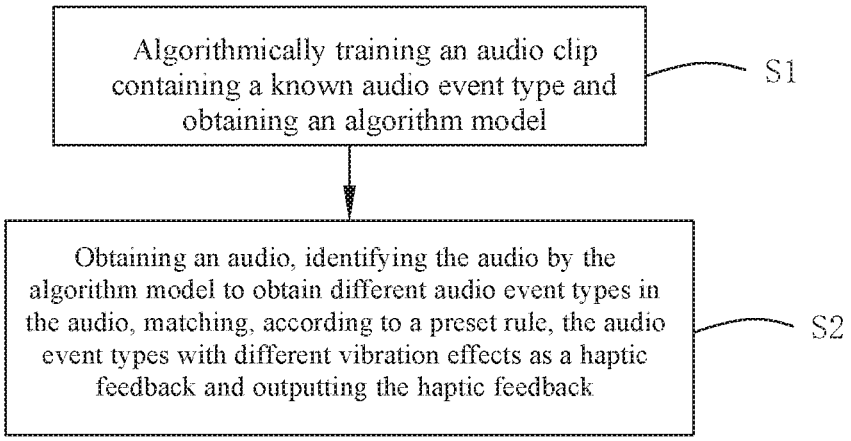
FIG. 1 is a flow chart of a haptic feedback method according to an embodiment of the present disclosure.
Figure 2:
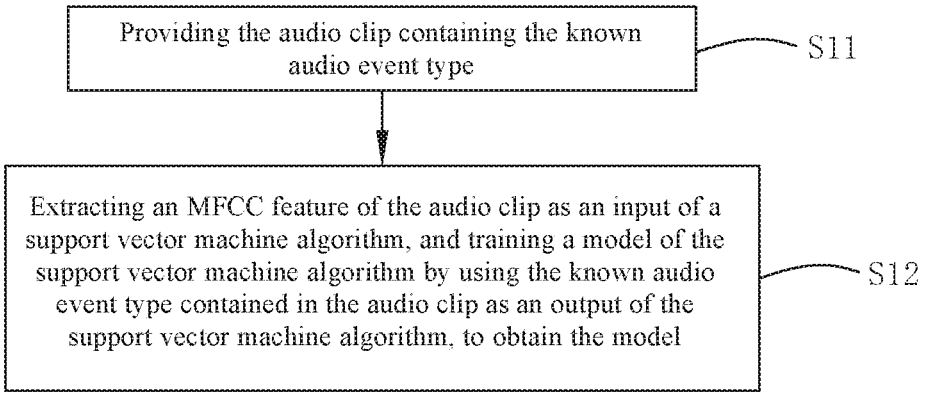
FIG. 2 is a partial flow chart of a step S1 of the haptic feedback method according to an embodiment of the present disclosure.
Figure 3:
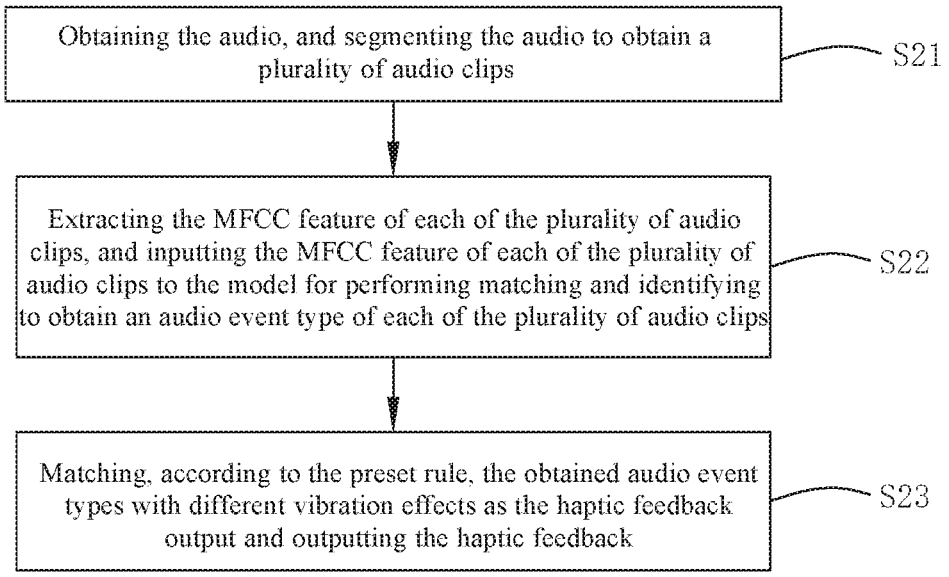
FIG. 3 is a partial flow chart of a step S2 of the haptic feedback method according to an embodiment of the present disclosure.

With reference to FIG. 1 to FIG. 3, the present disclosure provides a haptic feedback method applied to mobile electronic products, and the method includes a step S1 and a step S2 as described in the following.

At step S1, an audio clip containing a known audio event type is algorithmically trained and an algorithm model is obtained.

Further, in the step S1, the method specifically includes a step S11 and a step S12 as described in the following.

At step S11, an audio clip containing a known audio event type is provided.

At step S12, an MFCC feature of the audio clip is extracted and used as an input of a support vector machine (SVM) algorithm, and the known audio event type contained in the audio clip is used as an output of the support vector machine (SVM) algorithm, and the support vector machine (SVM) algorithm model is trained to obtain an algorithm model.

At step S2, an audio is obtained, and the audio is identified by the algorithm model to obtain different audio event types in this audio, and then these audio event types match different vibration effects as a haptic feedback output according to a preset rule.

Further, in the step S2, the method specifically includes a step S21, a step S22, and a step S23 as described in the following.

At step S21, an audio is obtained and framed to obtain a plurality of audio clips;

In one embodiment, before extracting the MFCC feature of the plurality of audio clips, the audio needs to be pre-emphasized, framed, and windowed, and then the plurality of audio clips are obtained after being pre-processed.

At step S22, the MFCC feature of each of the plurality of audio clips is extracted and input to the algorithm model for matching and identifying, to obtain the audio event type of each of the plurality of audio clips;

In one embodiment, in the step S22, extracting the MFCC feature of each of the plurality of audio clips includes: sequentially processing each of the plurality of audio clips by an FFT Fourier transform process, a Meyer frequency filter set filtering process, a logarithmic energy processing, and a DCT cepstrum processing, so as to obtain the MFCC feature.

It should be noted that each of the plurality of audio clips includes one of the audio event types. The audio event types may be obtained by artificial classification. In one embodiment, the audio event types include, but are not limited to, any one of shooting, explosion, object collision, screaming, or engine roaring.

At step S23, the obtained audio event types are matched with different vibration effects as a haptic feedback output according to a preset rule.

In one embodiment, in the step S23, the preset rule is: each of the audio event types corresponds to a different vibration effect.

It should be noted that the support vector machine (SVM) is a machine learning method based on a statistical learning theory. In one embodiment, the support vector machine (SVM) is configured to construct the algorithm model, and the audio is identified according to the algorithm model to obtain different audio event types, and then these vibration effects corresponding to the audio event types are output. The support vector machine (SVM) provides a condition to allow the haptic feedback method of the present disclosure to achieve real-time identification of the audio.

When the above method is applied to mobile electronic products, a particular haptic feedback effect can be customized according to an actual application scenario. The haptic feedback method of the present disclosure identifies the audio event type of the mobile electronic product in real time, thereby providing the mobile electronic product with the vibration effect matched with the audio event type. In this way, effects of games, music and videos of the mobile electronic product can be improved, thereby intuitively reconstructing a "mechanical" touch, and thus compensating for inefficiency of audio and visual feedback in a specific scenario. In this way, real-time haptic feedback can be achieved, thereby improving the user experience. For example, in a mobile game application, applying a haptic feedback technology to a mobile game can create a realistic sense of vibration, such as a recoil of a weapon or an impact of an explosion in a shooting game, or a vibratory sense of a guitar string in a musical instrument application. In an example, when we are playing a piano application, we can distinguish music sounds only by sounds without haptic feedback, but when the haptic feedback technology is provided, different vibration strengths can be provided according to different treble and bass, and thus the real vibration of the guitar can be simulated. In another example, in terms of music, it is possible to match vibrations having different strengths according to characteristics such as a beat or mega bass of music, thereby improving a notification effect such as an incoming call reminder, and thus providing a richer experience of a music melody and rhythm. In still another example, in terms of video, when we watch a movie, if the device can use the haptic feedback technology, we can feel that the device will generate a corresponding vibration as the scenario changes, which is also an improvement of user experience.

Compared with the related art, the haptic feedback method according to the embodiments of the present disclosure can identify the audio event type of the audio in real time, thereby outputting a vibration effect matched with the audio event type. When the haptic feedback method is applied to a mobile electronic product, the mobile electronic product can output a vibration effect matched with the audio event type according to the audio event type, thereby compensating for inefficiency of audio and visual feedback in a specific scenario. In this way, real-time haptic feedback can be achieved, thereby improving the user experience.

The above-described embodiments are merely preferred embodiments of the present disclosure and are not intended to limit the present disclosure. Any modifications, equivalent substitutions and improvements made within the principle of the present disclosure shall fall into the protection scope of the present disclosure.

What is claimed is:

1. A haptic feedback method, applied in an mobile electronic product, comprising:

step S1 of algorithmically training an audio clip containing a known audio event type and obtaining an algorithm model, comprising:

step S11 of providing the audio clip containing the known audio event type; and step S12 of extracting an MFCC feature of the audio clip as an input of a support vector machine algorithm, and training a model of the support vector machine algorithm by using the known audio event type contained in the audio clip as an output of the support vector machine algorithm, to obtain the model; and step S2 of obtaining an audio, identifying the audio by the algorithm model to obtain different audio event types in the audio, matching, according to a preset rule, the audio event types with different vibration effects as a haptic feedback and outputting the haptic feedback to the mobile electronic product, comprising:

step S21 of obtaining the audio, and segmenting the audio to obtain a plurality of audio clips;

step S22 of extracting the MFCC feature of each of the plurality of audio clips, and inputting the MFCC feature of each of the plurality of audio clips to the model for performing matching and identifying to obtain an audio event type of each of the plurality of audio clips; and step S23 of matching, according to the preset rule, the obtained audio event types with different vibration effects as the haptic feedback output and outputting the haptic feedback;

wherein in the step S22, extracting the MFCC feature of each of the plurality of audio clips comprises: processing each of the plurality of audio clips sequentially by an FFT Fourier transform process, a Meyer frequency filter set filtering process, a logarithmic energy processing, and a DCT cepstrum processing, so as to obtain the MFCC feature;

each of the plurality of audio clips comprises one of the audio event types.

2. The haptic feedback method as described in claim 1, wherein in the step S23, the preset rule is that each of the audio event types corresponds to a different vibration effect.

* * * * *